US005728262A

United States Patent [19]

Moss et al.

[11] Patent Number: 5,728,262

[45] Date of Patent: Mar. 17, 1998

[54] METHOD AND APPARATUS FOR REMOVING NEUTRAL BUOYANCY CONTAMINANTS FROM ACELLULOSIC PULP

[75] Inventors: Charles S. Moss, Snellville; Randolph S. Butler, Lawrenceville, both of Ga.

[73] Assignee: Tetra Laval Holdings & Finance, S.A., Pully, Switzerland

[21] Appl. No.: 668,290

[22] Filed: Jun. 21, 1996

[51] Int. Cl.[6] ..... D21D 5/24; B04C 3/04; B04C 5/28; B04C 5/04

[52] U.S. Cl. ..... 162/4; 162/55; 209/727; 209/728; 209/730; 209/731; 209/732; 209/733; 209/734; 210/512.2

[58] Field of Search ..... 162/4, 55; 209/727, 209/728, 730, 731, 732, 733, 734; 210/512.1, 512.2

[56] References Cited

U.S. PATENT DOCUMENTS

| | | | |
|---|---|---|---|
| 3,912,579 | 10/1975 | Braun . | |
| 4,151,083 | 4/1979 | Dove . | |
| 4,231,526 | 11/1980 | Ortner . | |
| 4,253,945 | 3/1981 | Karnis . | |
| 4,276,119 | 6/1981 | Karnis . | |
| 4,473,478 | 9/1984 | Chivrall . | |
| 4,605,495 | 8/1986 | Flynn . | |
| 5,131,980 | 7/1992 | Chamblee et al. | 162/4 |
| 5,192,397 | 3/1993 | Bohman . | |
| 5,337,899 | 8/1994 | Andersson et al. | 209/728 |
| 5,566,835 | 10/1996 | Grimes . | |
| 5,587,078 | 12/1996 | Leblanc . | |

FOREIGN PATENT DOCUMENTS

WO 93/10908 10/1993 WIPO .

*Primary Examiner*—Thomas M. Lithgow
*Attorney, Agent, or Firm*—Troutman Sanders LLP; Gerald R. Ross; Joel S. Goldman

[57] ABSTRACT

An asymmetric hydrocyclone is modified and controlled so as to effectively remove contaminants of substantially neutral buoyancy from a paper cellulosic pulp. More specifically, a method includes prepositioning a substantially frusto-conically-shaped separation chamber of the hydrocyclone at an oblique angle to a vertical axis, and introducing a cellulosic pulp through an inlet and into the separation chamber for separation processing. As is known, the pulp composition forms a downwardly-directed helical path, which in turn establishes an opposingly directed, upward helical air core. Centrifugal forces motivate heavier particles toward the sidewalls of the separation chamber and lighter particles are urged toward the air core, with particles of substantially neutral buoyancy circumferentially collected in an intermediate region, but in relatively close proximity to the air core. The method further includes the step of relationally controlling pulp composition pressure at the inlet and outlet to constrict and stabilize the air core and move the intermediate region containing neutrally buoyant contaminants into a reject stream formed near a reject tap.

8 Claims, 2 Drawing Sheets

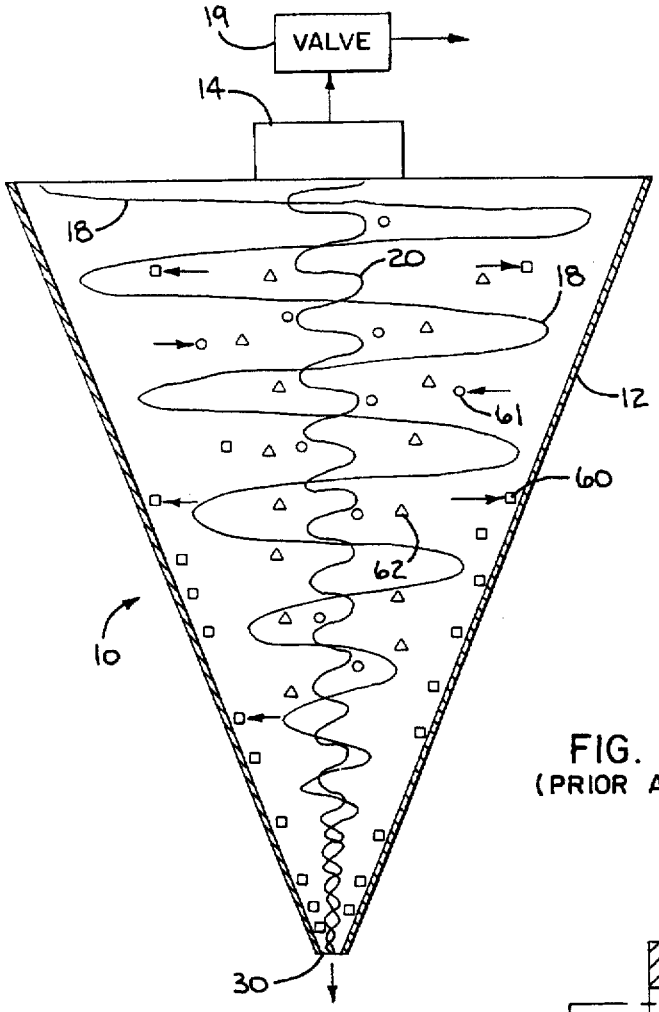
FIG. 1
(PRIOR ART)
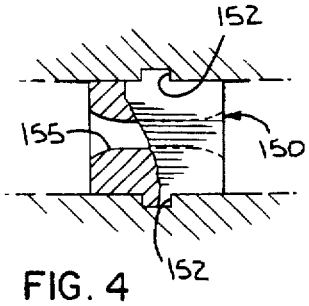
FIG. 4
FIG. 3
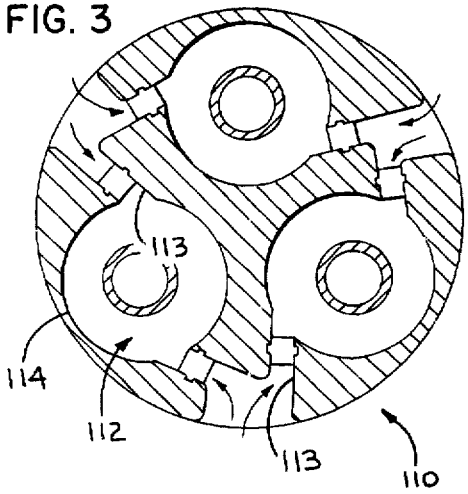
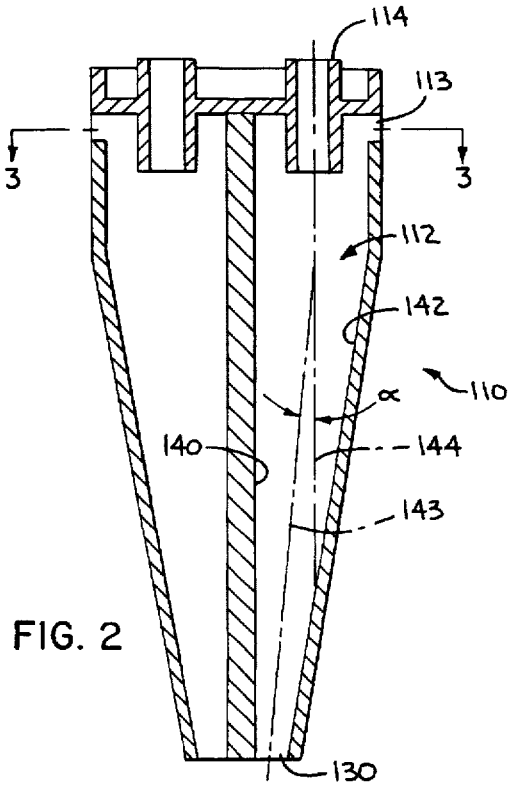
FIG. 2

METHOD AND APPARATUS FOR REMOVING NEUTRAL BUOYANCY CONTAMINANTS FROM ACELLULOSIC PULP

FIELD OF THE INVENTION

The present invention generally relates to paper recycling apparatus, and more particularly to a method and apparatus for removing contaminants of substantially neutral buoyancy from a paper cellulosic pulp, as a purification step in a paper recycling process.

DISCUSSION OF THE RELATED ART

Propelled in part by environmental and conservation concerns and in part by economic realities, the recycling industry has experienced tremendous growth in recent years. In the area of paper-product recycling alone, the proliferation of business copiers, printers, and fax machines has significantly increased the supply of readily recyclable paper products. In addition, envelopes, phone books, fiberboard cartons, newspapers, and a variety of other paper products collectively add to the supply of recycled paper products.

Generally, the paper recycling process includes the steps of adding water to the paper-product supply to be recycled and converting that solid-liquid mixture into a cellulose pulp or slurry having a solid composition of approximately two to six percent. This pulp composition is subsequently screened and filtered to remove contaminants. The pulp may be then squeezed to remove the water and, thereafter, formed into a variety of paper products.

More specifically, and as is known by those of ordinary skill in the paper recycling industry, a variety of contaminants are present within a recycling pulp composition, including inks, dyes, sand, dirt, polystyrene, waxes, and stickies. Moreover, the contaminants comprise an assortment of sizes, weights, and densities. Multiple apparatus are utilized to process the pulp composition and separate the various contaminants. Typically, separate apparatus are cascaded along the flow path of the pulp composition, with each apparatus uniquely adapted to remove a particular type or size contaminant.

For example, screens are utilized early in the filtration process to remove relatively large contaminants. Thereafter, washers are often used to remove relatively small contaminant particles. Those skilled in the art will appreciate that a variety of screens and washers are utilized for the above-mentioned purposes.

Downstream of the screens and washers, other filtration devices are used to perform further filtration. Specifically, centrifugal separators, or hydrocyclones, have long been used as a means to separate contaminants from a pulp composition in a paper recycling process. Generally, a hydrocyclone includes a frusto-conically-shaped separation chamber into which the pulp composition is injected so as to travel in a downward helical path. As a result, an upwardly-directed helical air core is established. Due to the centrifugal forces, materials of higher density are urged outwardly to the sidewalls of the separation chamber, forcing lower density materials inwardly toward the air core. As the chamber tapers toward the bottom, the centrifugal forces increase in conjunction with the decreasing diameter of the separation chamber.

In forward or series or combination hydrocyclones, an outlet is provided in the bottom of the separation chamber and the pulp composition is discharged to atmosphere by internal pressure through the outlet. Additionally, in the series or combination cleaner, lighter density contaminants are carried upwardly adjacent the air core, toward the top of the chamber. A reject tap may be provide near the top of the chamber through which these contaminants may be expelled. In this way, lighter density contaminants are separated and filtered from the pulp composition which is discharged through the outlet.

In a reverse cleaner, a reject tap is provided at the top of the chamber coincident with the geometric centerline. Likewise, an outlet is provided at the bottom of the chamber. In a flow-through cleaner, a reject tap is provided at the bottom of and with the geometric centerline of the cleaner. The cleaner outlet is also positioned at the bottom of the cleaner but not necessarily coincident with the geometric centerline. By controlling the pressure differential (between the inlet and outlet) in reverse or flow-through hydrocyclones, the processed pulp, along with the heavier density contaminants are discharged through the outlet, while lighter density contaminants are expelled through the reject tap.

The various cleaners described above may further include a valve at the reject tap for control purpose. More specifically, this valve may be utilized to prevent the expelling of too much material, instead redirecting a portion of that material to the cleaner outlet.

By cascading forward-type and reverse-type hydrocyclones, both low and high density contaminants are removed from the pulp composition. Contaminants of substantially neutral buoyancy, however, remain. That is, contaminants having a specific gravity near the specific gravity of water (i.e., one gram per milliliter) collect in a circumferential layer between the air core and the outer sidewall. In both forward and reverse hydrocyclones, the neutral buoyancy contaminants are generally carried with the pulp composition and discharged through the outlet, and therefore remain in the composition.

Significantly, stickies are a predominant form of contaminant that span the range of neutral buoyancy. However, other forms of contaminants fall within this near-neutral buoyancy range as well. As is well known, primary sources of sticky contaminants include single side pressure sensitive tapes of various types, double face splicing tapes, hot melt glue, pressure sensitive labels, self-seal envelopes, and stick-on notes. The sticky contaminants that are present within the pulp composition are manifest in a variety of sizes, including particles sufficiently small to readily pass through the initial filtering screens, and larger particles whose composition permitted the particles to extrude sufficiently to pass through the screens.

U.S. Pat. No. 5,131,980 (hereinafter the '980 patent) discloses an apparatus that is directed to separating stickies from such a pulp composition. The apparatus of the '980 patent is a reverse-type hydrocyclone that sparges air into the circulating pulp composition. Since sticky contaminants are generally hydrophobic, the lighter weight sticky contaminants readily attach to the air bubbles and are carried into the air core and expelled through a reject tap. The apparatus of the '980 patent, however, does not address the heavyweight stickies. Indeed, the '980 patent does not differentiate between the significance of buoyancy versus weight at all.

U.S. Pat. No. 5,337,899 (hereinafter the '899 patent), assigned to a corporate-affiliate of the assignee of the present invention, discloses a grouped hydrocyclone, wherein a group of three hydrocyclone separation chambers are aggregated into a single, tapered chamber. As a result of this grouping, the hydrocyclones are disposed so that the geometric centerlines of the individual separation chambers are obliquely disposed in relation to a vertical axis. Accordingly, this type of hydrocyclone is also referred to as an asymmetric hydrocyclone.

As described in the '899 patent, the grouped structure of the apparatus provides a hydrocyclone that is compact, and enables easy servicing of the individual hydrocyclones. As will be described in more detail below, the general structure of the apparatus described in the '899 patent has been modified to provide the method and apparatus of the present invention. However, as will be appreciated from the description that follows, the present invention is not limited to such grouped hydrocyclones.

SUMMARY OF THE INVENTION

Accordingly, a primary object of the present invention is to provide a method and apparatus for separating contaminant particles of substantially neutral buoyancy from a cellulosic pulp composition as a step in a larger paper recycling process.

A more specific object of the present invention is to adapt and control an asymmetric hydrocyclone to effect significant removal of neutral buoyancy contaminants.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, the present invention is generally directed to a method of utilizing a forward-flow hydrocyclone to remove contaminants of substantially neutral buoyancy from a paper cellulosic pulp. In accordance with one aspect of the invention, the method includes prepositioning a substantially frusto-conically-shaped separation chamber of the hydrocyclone at an oblique angle to a vertical axis, and introducing a cellulosic pulp of approximately 0.5% to 2.0% solid composition including contaminants through an inlet and into the separation chamber for separation processing. Upon injection, the pulp composition forms a downwardly-directed helical path, which in turn establishes an opposingly directed, upward helical air core. Due to the centrifugal forces, heavier particles are motivated toward the sidewalls of the separation chamber and lighter particles are urged toward the air core, with particles of substantially neutral buoyancy circumferentially collected in an intermediate region, but in relatively close proximity to the air core. The method further includes the steps of channelling processed cellulosic pulp composition through an outlet disposed substantially over the centerline of the separation chamber, and relationally controlling pulp composition pressure at the inlet and outlet to constrict and stabilize the air core and move the intermediate region containing neutrally buoyant contaminants into a reject stream formed near a reject tap. In this regard, the relational pressure is controlled to effect a point of impingement of a central axis of the air core along the sidewall of the separation chamber, whereby, due the impingement, heavier particles are redistributed into the cellulosic pulp and neutrally buoyant particles are introduced into the reject stream for rejection through the reject tap.

DESCRIPTION OF THE DRAWINGS

The accompanying drawings incorporated in and forming a part of the specification, illustrate several aspects of the present invention, and together with the description serve to explain the principles of the invention. In the drawings:

FIG. 1 is a cross-sectional side view of a prior art symmetrical hydrocyclone, illustrating the flow patterns of contaminant particles of varying density;

FIG. 2 is a cross-sectional view of an asymmetric hydrocyclone, preferably utilized in accordance with the invention;

FIG. 3 is a top view of the hydrocyclone of FIG. 2, as taken substantially along line 3—3 shown in FIG. 2;

FIG. 4 is a more detailed view of one of the inlet nozzels shown in FIG. 3;

Figure 5:
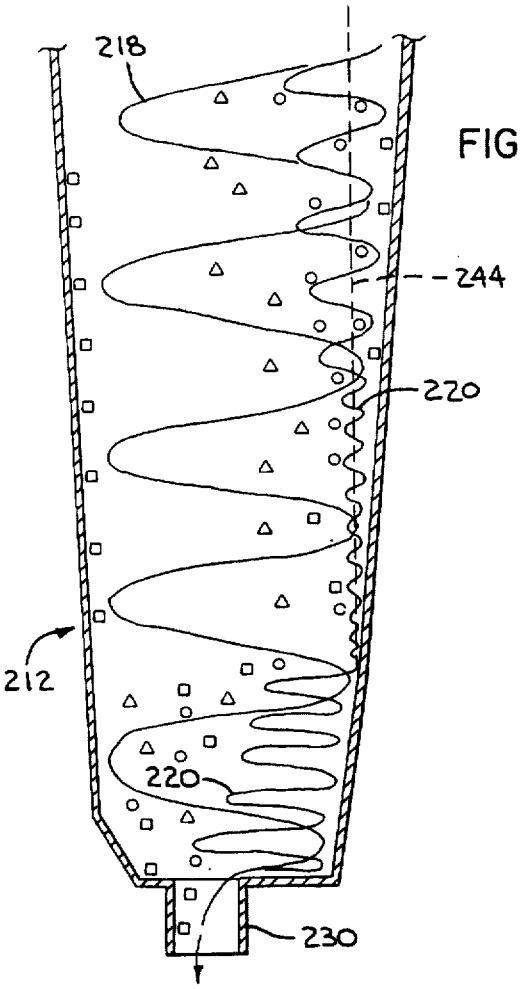
FIG. 5 is an expanded view of a lower portion of one of the separation chambers of the hydrocyclone shown in FIG. 2, and depicting the fluid flow in that portion of the chamber.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

DETAILED DESCRIPTION OF THE PREFERRED EMBODIMENT

Turning now to the drawings, FIG. 1 illustrates a symmetrical hydrocyclone 10 of a type known in the prior art. The hydrocyclone is symmetric in that it includes a separation chamber 12 that is defined by a substantially frusto-conically-shaped envelope. Although the configuration of the apparatus of FIG. 1 is well known, it is presented herein to more fully describe the fluid dynamics briefly discussed above. This discussion will provide the proper foundation for advancing the discussion into the fluid dynamics present in asymmetric hydrocyclones in order to obtain a better appreciation of the present invention.

As illustrated in FIG. 1, a hydrocyclone 10 includes a frusto-conically-shaped separation chamber 12. In use, a cellulosic pulp of approximately 0.5 percent to two percent solid composition is introduced into the separation chamber through one or more inlets (not shown in FIG. 1). The introduced composition establishes a generally downwardly-directed helical path 18, which results in an opposing, upwardly-directed helical air core 20.

An outlet 14 is disposed to overly the upwardly directed air core 20, through which the processed pulp composition is discharged. In a forward-type hydrocyclone, a pressure differential is maintained between the inlet and the outlet 14, in order to motivate the flow of processed pulp through the outlet 14. In this regard, a valve 19 is disposed in connection with the outlet 14 to establish and maintain a back pressure on the pulp composition. This valve 19 may be any of a variety of types, including a manual valve, an automatic flow-control valve, or an automatic pressure-control valve. An approximately eighteen to twenty pound-per-square-inch (PSI) pressure differential is typically maintained between the inlet and outlet 14. More specifically, inlet pressure in a commonly used hydrocyclone is generally maintained at approximately twenty three PSI, while back pressure is maintained at approximately five PSI.

Centrifugal forces associated with the circular, or helical, fluid flow exert outwardly-directed radial forces on the pulp composition. As a result, contaminants within the pulp composition having higher density are forced toward the sidewalls of the separation chamber 12. Counteracting forces urge the lighter density particles toward the central air core 20. In the drawings, squares 60 are used to represent higher density particles, circles 61 represent lighter density particles, and triangles 62 are used to represent neutral buoyancy particles.

As will be appreciated by those of ordinary skill, the acting centrifugal forces are inversely proportional to the radius of the curved or circular path. Therefore, as the separation chamber 12 tapers toward the bottom, centrifugal forces increase, further enhancing the separation process. Heavy contaminants are forced outwardly and down along the outer sidewalls, and are ultimately expelled from a reject tap 30, located at the bottom of the chamber. Lighter contaminant particles are urged toward the air core and, due to the pressure differential, are discharged through the outlet 14 along with the processed pulp composition. These lighter contaminants may be filtered from the pulp composition by subsequent separators. As shown, the various particles may be mixed within the composition near the upper portion of the separation chamber 12. However, contaminant separation has significantly occurred near the bottom of the chamber 12, due in part to the increased centrifugal forces, and in part to the longer exposure time within the chamber 12.

Referring now to FIGS. 2 and 3, the hydrocyclone 110 of the preferred embodiment is shown. FIG. 2 is a cross-sectional side view, showing two chambers of the hydrocyclone 110, while FIG. 3 illustrates a top view as taken substantially along line 3—3 of FIG. 2. This preferred hydrocyclone includes three individual separation chambers e.g., 112 grouped in a single housing. Each chamber 112 includes two inlets 113, an outlet 114, and a reject tap 130, which serve the same functions described for the hydrocyclone 10 of FIG. 1.

Unlike the hydrocyclone 10 of FIG. 1, however, the separation chambers 112 of the hydrocyclone 110 of FIG. 2 are asymmetric. While the inner sidewall 140 is substantially vertically disposed, the outer sidewall 142 is sloped to taper inwardly from the top to the bottom. As illustrated by angle $\alpha$, the geometric centerline 143 of the chamber 112 is obliquely disposed to the vertical axis 143 that is coincident with the geometric centerline 143, at the top of the chamber 112. The air core is established along the vertical axis 144. The affect of this angular divergence will be more fully discussed with regard to FIG. 5.

First, however, reference is made briefly to FIG. 4 to describe the chamber 112 inlets 113. In a manner known by those skilled in the art, a cellulosic pulp composition is delivered through a single inlet port (not shown) of the housing, immediately above the separation chambers 112. The arrows of FIG. 3 illustrate the manner in which the composition may flow, in order to enter the individual separation chambers 112. At the mouth of each chamber inlet 113, an inlet nozzle or plate 150 (FIG. 4) is provided to restrict the flow of the composition at the inlet 113.

Preferable, opposing slots 152 are disposed at the mouth of the inlet 113 to readily receive an interchangeable inlet plate 150. The inlet plate includes an interior passage 155, through which the pulp composition passes. Substituting inlet plates 150 with smaller diameter passages serves to restrict the inlet opening, increasing the inlet pressure and restricting the flow rate. As will be more fully set forth in the discussion and examples presented below, an important aspect of the present invention relates to the controlled restriction of the inlet passages 155, to control the fluid dynamics within the separation chamber so as to effectively remove neutral buoyancy contaminant particles.

In this regard, reference is made to FIG. 5, which shows the lowermost portion of an asymmetric separation chamber. The fluid dynamics within an asymmetric separation chamber 212 is very similar to that described in connection with the symmetric separation chamber of FIG. 1, at least in the top portion of the chamber. However, as the vertical axis 244 (See FIG. 2), along which the air core forms, approaches the sidewalls 242 of the chamber 212, the dynamics change. Specifically, as the air core approaches the sidewall, it begins to bend or curve away therefrom, and becomes unstable. As a result, centrifugal forces are disrupted causing a redistribution of the particles within the lower portion of the chamber.

Utilizing this understanding, the apparatus may be modified in accordance with the present invention to remove the neutral buoyancy contaminants. In this regard, a first step was to increase the back pressure from approximately five PSI to approximately 37 PSI. Before this change, the asymmetric hydrocyclone was virtually ineffective at filtering neutral buoyancy particles, having only a 0.5 percent efficiency. The change in back pressure alone resulted in an efficiency improvement of approximately 25–30%.

The second step is to constrict the inlet passage to decrease the flow rate at any given pressure. In a preferred embodiment, an inlet plate 150 (See FIG. 4) with a nine millimeter diameter inlet passage 155 is used, and external conditions increase the inlet pressure from approximately twenty three PSI to approximately fifty five PSI. Coupled with the increased back pressure, this further raised the efficiency to 50%–80% in the removal of neutrally buoyant contaminant particles.

Figure 6:
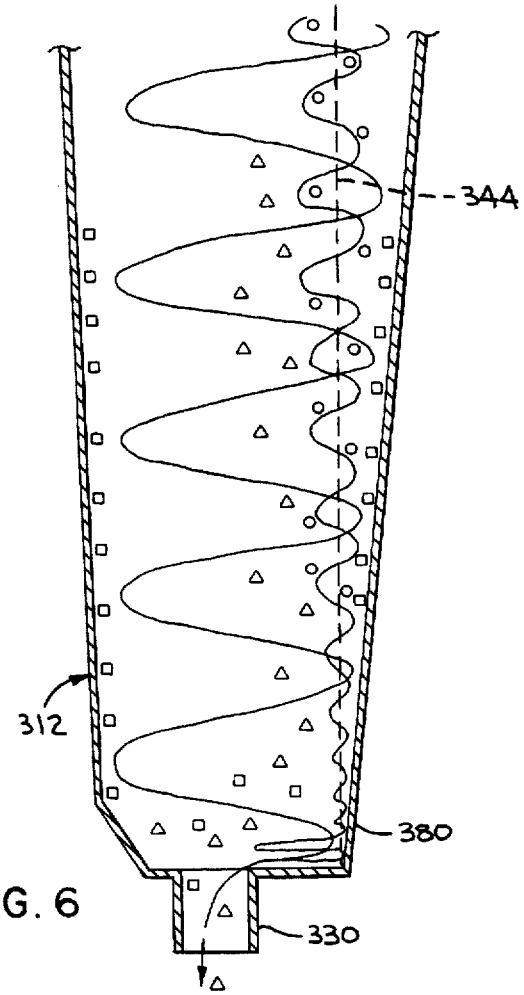
FIG. 6 is a view similar to that of FIG. 5, but illustrating the altered fluid dynamics resulting from the changes to the inlet and back pressures in accordance with the present invention.

FIG. 6 illustrates the fluid dynamics that result from the above-described changes. The increase pressures operate to constrict and stabilize the central air core 320. Significantly, the increased pressures move the point of impingement 380 of the air core and the sidewall of the separation chamber closer to the reject tap 330. As a result, the neutrally buoyant contaminants that collect circumferentially about the air core are redistributed at a location sufficiently close to the reject tap 330 to place the neutrally buoyant contaminants into a reject stream that expels them out the reject tap 330.

It is important to note that the efficiencies of the present invention are achieved as a combination of both the increased inlet and back pressures, and the asymmetry of the separation chamber 312. Indeed, merely increasing the inlet and back pressures of a symmetrical hydrocyclone will not achieve a filtration of neutrally buoyant contaminants. Instead, greater pressures will result in a greater expulsion of heavy contaminant particles. With heavy contaminant particles blocking the reject tap, neutrally buoyant particles will be discharged along with the processed pulp composition.

Importantly, the asymmetrical shape of the separation chamber 312 causes a redistribution of contaminant matter near the reject tap 330. Redistributing heavy particles within the composition clears the way for the neutrally buoyant particles to be expelled from the reject tap 330.

In an alternative embodiment, it may be desired to move the reject tap 330 from a point near the center of the separation chamber, radially outward toward the sidewall. Bringing the reject tap 330 closer to the point of impingement may further increase the efficiency by moving the reject stream to a point where more neutrally buoyant contaminant particles will be expelled.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A method for processing a paper cellulosic pulp to remove contaminants of substantially neutral buoyancy, said method comprises utilizing a hydrocyclone, wherein the hydrocyclone includes a substantially frusto-conically-shaped, separation chamber, an inlet through which a contaminated cellulosic pulp composition is introduced to the separation chamber, a reject tap disposed near the bottom of the separation chamber through which separated contaminants are expelled, an outlet through which the processed cellulosic pulp composition is expelled, and valves disposed in connection with the outlet and the reject tap, said method further comprises removing contaminant particles of substantially neutral buoyancy from the cellulosic pulp composition, wherein the removing of neutral buoyancy contaminants further comprises the steps of:

predisposing the separation chamber at an oblique angle to a vertical axis, wherein an air core that is vertically formed as a result of helical circulation of the pulp composition and is coincident with the geometric centerline at the top of the separation chamber, impinges a sidewall of the separation chamber at a point above and spaced apart from the reject tap;

constricting the inlet to decrease the internal flow rate;

increasing the pressure to the inlet to a value of over 35 pounds per square inch (PSI);

controlling the valves to increase back pressure to an amount of at least 15 PSI so as to constrict the diameter of the air core, increase its stability, and move particles of substantially neutral buoyancy toward the reject tap; and maintaining a controlled relationship between the inlet and back pressures to redistribute a portion of heavy contaminants in the separation chamber to allow for rejection of neutral buoyancy particles through the reject tap.

2. The method according to claim 1, wherein the step of controlling the valves includes controlling the valve to increase the back pressure to approximately 37 PSI.

3. The method according to claim 1, wherein the step of increasing the pressure to the inlet includes increasing the pressure to approximately 55 PSI.

4. The method according to claim 1, wherein the reject tap is disposed along the geometric centerline of the separation chamber, at the bottom thereof.

5. The method according to claim 1, wherein the reject tap is offset from the centerline of the separation chamber.

6. The method according to claim 1, wherein the step of constricting the inlet is performed by interchanging an inlet plate having a passage of a first diameter with an inlet plate having a passage of a second diameter.

7. The method according to claim 6, wherein a plurality of inlet plates are associated with the separation chamber.

8. The method according to claim 1, wherein the introduced contaminated cellulosic pulp composition is approximately a 0.5% to 2.0% solids composition.

* * * * *